United States Patent [19]

Carreno

[11] Patent Number: 4,497,613

[45] Date of Patent: Feb. 5, 1985

[54] TAPERED CORE EXIT FOR GAS TURBINE BUCKET

[75] Inventor: Diether E. Carreno, Schenectady, N.Y.

[73] Assignee: General Electric Company, Schenectady, N.Y.

[21] Appl. No.: 461,007

[22] Filed: Jan. 26, 1983

[51] Int. Cl.[3] ..... F01D 5/10

[52] U.S. Cl. ..... 416/228; 416/500

[58] Field of Search ..... 416/228 A, 500, 228, 416/223 A, 92

[56] References Cited

U.S. PATENT DOCUMENTS

| | | | |
|---|---|---|---|
| 2,823,895 | 2/1958 | Floroff | 416/229 A |
| 4,097,192 | 6/1978 | Kulina | 416/228 X |

FOREIGN PATENT DOCUMENTS

| | | | |
|---|---|---|---|
| 909059 | 4/1954 | Fed. Rep. of Germany | 416/92 |
| 1087745 | 8/1960 | Fed. Rep. of Germany | 416/228 |
| 779591 | 11/1980 | U.S.S.R. | 416/228 |

*Primary Examiner*—Stephen Marcus
*Assistant Examiner*—Joseph M. Pitko
*Attorney, Agent, or Firm*—J. C. Squillaro

[57] ABSTRACT

A transition portion adjacent the uncored section at a trailing edge of a cored turbine bucket displaces some of the regions of maximum stress concentration so that the maxima do not superpose and produce radial cracking at the junction of the uncored section with the walls of the cored portion. The transition section includes a curved portion joining a ramp leading to the tip.

6 Claims, 7 Drawing Figures

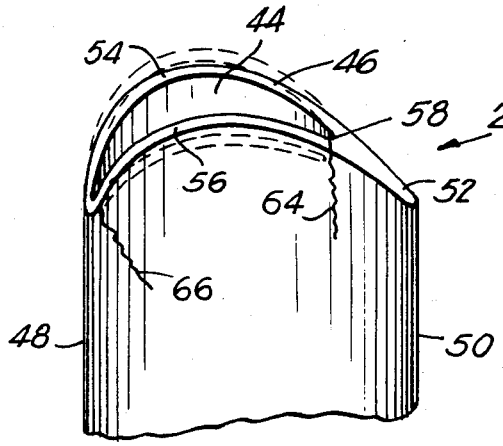
PRIOR ART
FIG. 3
PRIOR ART
FIG. 4
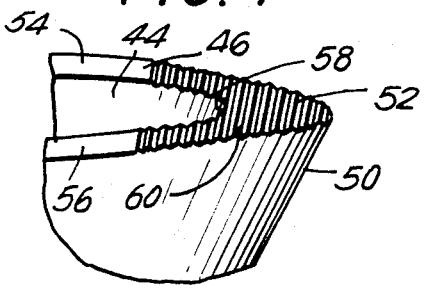
PRIOR ART
FIG. 5
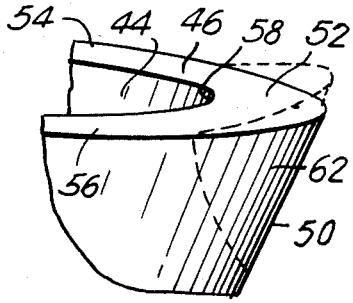

FIG. 6
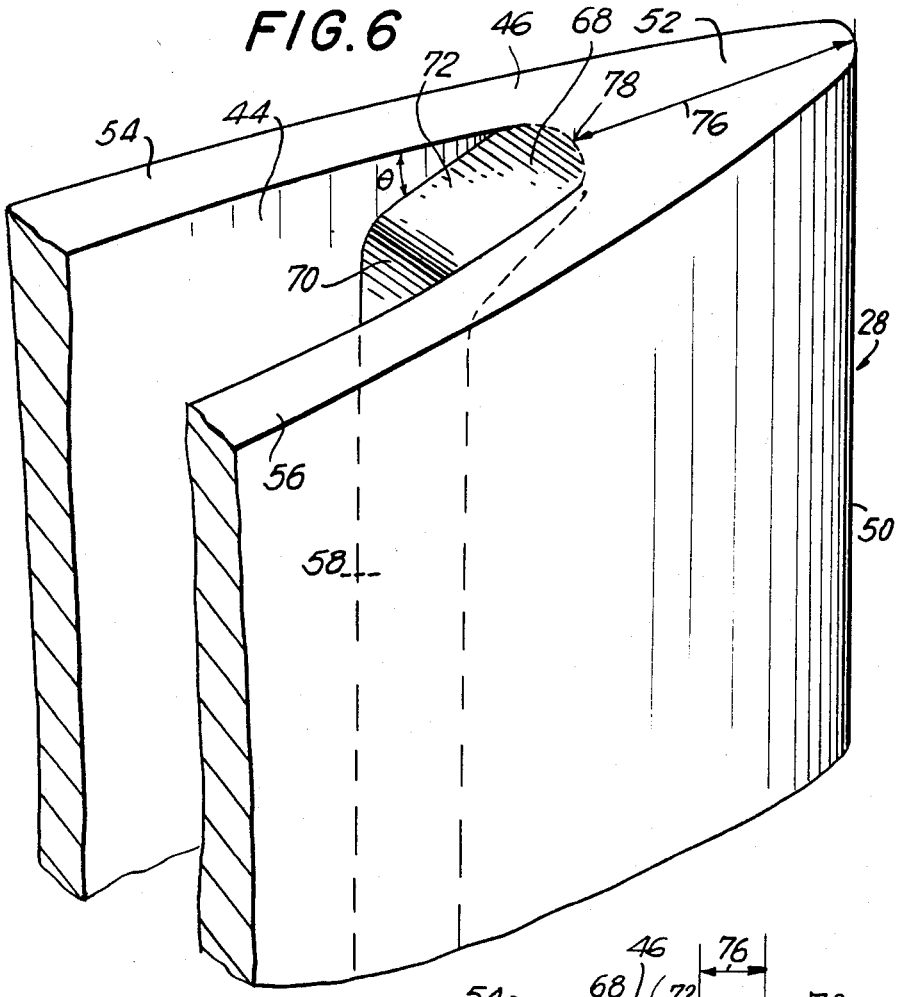
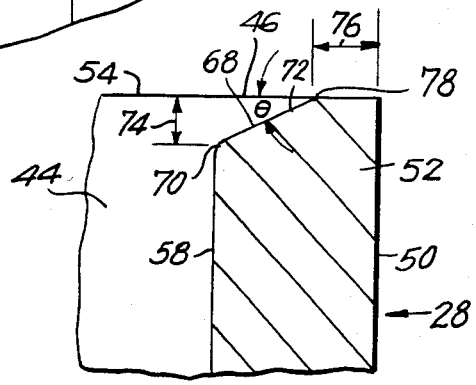
FIG. 7

TAPERED CORE EXIT FOR GAS TURBINE BUCKET

BACKGROUND OF THE INVENTION

The present invention relates to gas turbines and, more particularly, to industrial or heavy-duty gas turbines. Even more particularly, the present invention relates to modified buckets in the first turbine stage of a gas turbine engine for reducing the probability of radial cracking.

The efficiency of thermal engines is improved by increasing the temperature of the heated fluid being employed. In a gas turbine engine, the heated fluid is a mixture of air and combustion products produced by burning fuel. This heated gas mixture is impinged on buckets of one or more turbine stages to produce torque. The maximum temperature which can be used is limited by the availability of materials which can withstand deformation and/or destruction at a given temperature. To maximize efficiency in a modern industrial heavy-duty type turbine, the turbine buckets are produced from special alloys which exhibit high strength and toughness retention at elevated temperatures. Such alloys and the processes for casting and finishing the turbine buckets are expensive. Furthermore, the cost of a gas turbine engine is great enough that a long useful life must be anticipated for economical use.

In order to reduce the rotating mass and radial forces on the dovetail region and rim of a turbine wheel, and to improve tip sealing, it has been customary to core or hollow an outer portion of the buckets especially of the first-stage turbine of a gas turbine engine. For greatest reduction in weight, the remaining walls of the cored portions should be as thin as possible. The wall thinness is limited in the region of the trailing edge which customarily is thinned down almost to a knife edge. Consequently, it has been conventional to leave an uncored section along the trailing edge behind the cored portion.

The thin walls appear to be subject to vibratory excitation which may produce stress concentrations at the junction of the uncored trailing edge with the walls. At least two types of vibratory excitation appears to be capable of superposing contributions to stress concentrations at this junction, particularly at the tip. A third source of stress concentrations, namely grooves or striations from tip rubbing, can also occur in this same location to produce an enhanced opportunity for crack initiation.

One solution which has been applied is to increase the thickness of the walls of the cored portion to thereby raise the resonant vibratory frequencies. Although this may be effective in reducing radial cracking, it is contrary to the desire for reduced weight and loading of the buckets.

Once radial cracks have begun, they may propagate to destructive failure thus seriously damaging or destroying expensive apparatus. When cracks are discovered, there are few alternatives to replacement of the affected bucket. If cracks are discovered when very small, there is the possibility that they can be ground out with a consequent reduction in aerodynamic efficiency of the turbine stage and with an imbalance which must be cured possibly by correspondingly grinding an opposed bucket. Since turbine buckets are produced from high-cost superalloys, the cost of replacement is substantial.

OBJECTS AND SUMMARY OF THE INVENTION

Accordingly, it is an object of the invention to provide a turbine bucket which overcomes the drawbacks of the prior art.

It is a further object of the invention to provide a turbine bucket having improved resistance to radial cracking.

It is a further object of the invention to provide a cored turbine bucket with a transition region between the core and the uncored trailing edge to reduce or eliminate stresses at the tip.

It is a further object of the invention to provide a cored turbine bucket wherein a transition region adjacent the uncored trailing edge displaces regions of maximum stress concentrations so that they do not superpose.

According to an aspect of the present invention, there is provided a turbine bucket of the type having an aerodynamic section, a shank section and a dovetail section, comprising a cavity in the aerodynamic section extending inward from a tip of the aerodynamic section, the cavity defining walls adjacent thereto, an uncored section between the cavity and at least one of a trailing edge and a leading edge of the bucket, a transition between an end of the cavity adjacent the uncored section and the tip, the transition beginning between the walls at a distance from the tip, the transition including at least a curved portion, and the distance and the at least a curved portion being effective to displace a location of a maximum stress concentration produced by at least one vibration mode a sufficient distance from a location of a maximum stress concentration produced by at least one other source of stress concentration that crack initiation in the walls in inhibited.

According to a feature of the present invention, there is provided a method of forming a cored turbine bucket, comprising forming a core in a mold, extending the core radially inward from a tip end of the mold to produce a radial cavity in an aerodynamic section of the bucket, allowing an uncored section between an end of the core and at least one of a trailing edge and a leading edge of the core, forming a transition in the core to produce a transition in a bucket molded therewith, the transition beginning at a distance from the tip end, the transition including at least a curved portion, positioning the curved portion to produce a value of the distance which displaces a location of a maximum stress concentration produced in the bucket by at least one vibration mode a sufficient distance from a location of a maximum stress concentration produced by at least one other source of stress concentration that crack initiation near the uncored section is inhibited, and molding the bucket.

The above, and other objects, features and advantages of the present invention will become apparent from the following description read in conjunction with the accompanying drawings, in which like reference numerals designate the same elements

BRIEF DESCRIPTION OF THE DRAWINGS

FIG. 3 is a perspective view of a portion of a turbine bucket illustrating one of the vibration modes leading to cracking.

FIG. 4 is a closeup of a portion of the bucket of FIG. 3 showing striations or grooves produced therein by rubbing.

FIG. 5 is a view corresponding to FIG. 4 illustrating a tip flap mode of vibration of a bucket.

FIG. 6 is a partial perspective view of a bucket according to the present invention.

FIG. 7 is a cross section of the bucket of FIG. 6.

DETAILED DESCRIPTION OF THE PREFERRED EMBODIMENT

Figure 1:
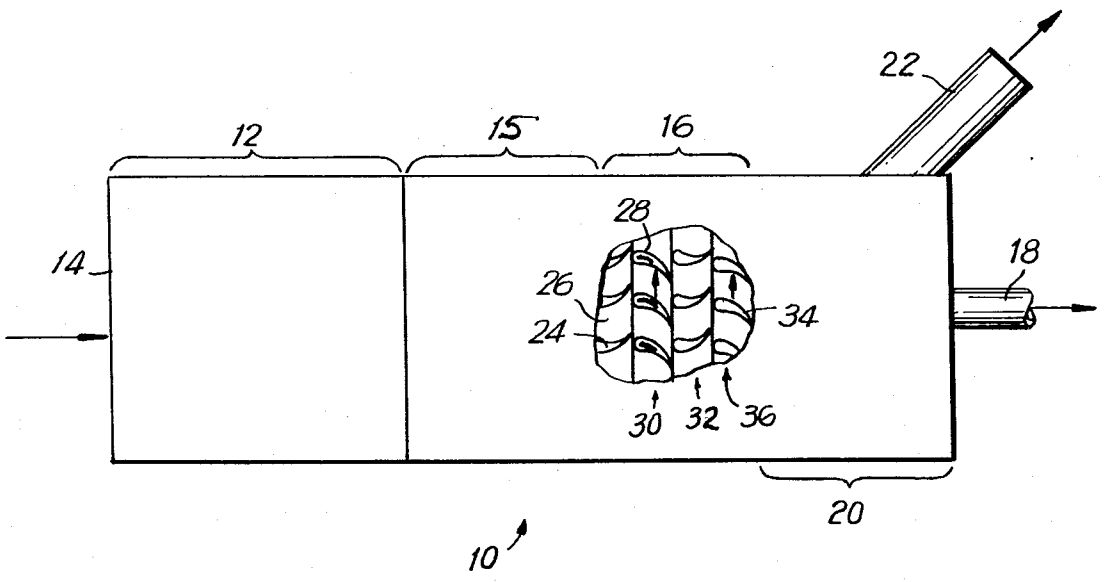
FIG. 1 is a simplified diagram of a gas turbine engine with a portion of the turbine portion cut away to reveal internal components.

Referring now to FIG. 1, there is shown, generally at 10, an industrial or heavy-duty gas turbine of the type in which the present invention may be employed. A compressor section 12, which may include, for example, 15 to 17 rotary compressor stages, receives ambient air at an inlet 14, compresses it, and delivers it to a combustor 15. In combustor 15, fuel is mixed with the compressed air and the mixture is ignited to provide a supply of high-temperature air and combustion products. The air and combustion products are delivered at high speed to a turbine section 16 in which a portion of the thermal energy is converted to mechanical energy for operation of the compressor in compressor section 12 and for the generation of an output on an output shaft 18. An exhaust section 20 delivers the spent gases through an exhaust stack 22 either for venting or secondary recovery of heat such as, for example, regeneration or for direct or indirect use in an accompanying industrial process.

In turbine section 16, a ring of aerodynamically shaped stationary partitions 24 form nozzles 26 therebetween for turning and accelerating the energetic stream of heated gas and air for impingement on blades or buckets 28 of a first-stage turbine wheel 30. The impingement of gas on buckets 28 rotates first-stage turbine wheel 30 in the direction of an arrow.

One or two additional turbine wheel stages may be employed to further utilize remaining kinetic energy in the gas stream. A second row of nozzles 32 again turns and accelerates the hot gas leaving first-stage turbine wheel 30 for impingement on buckets 34 of a second-stage turbine wheel 36. First- and second-stage turbine wheels 30 and 36 may be coupled to a common output shaft 18 for conjoint rotation. Alternatively, first-stage turbine wheel 30 may be coupled to a shaft (not shown) for driving compressor section 12 and second-stage turbine wheel 36 may be independently connected to output shaft 18.

Compressor section 12, combustor 15 and exhaust section 20 are conventional and thus further detailed illustration and description thereof are omitted.

The construction of turbine section 16 is also conventional, except for the application of the present invention to buckets 28 of first-stage turbine wheel 30 and the possible application to buckets 34 of subsequent stage turbine wheels.

In order to reduce the mass of first-stage buckets 28 and to thereby reduce the centrifugal load on first-stage turbine wheel 30, it has been customary to core or hollow an outer portion of first-stage turbine buckets 28. Although it may be desirable to do so, second and subsequent stage turbine buckets have not customarily been hollowed since these buckets are longer and thinner thus providing less cross section in which coring might be used. Also, their thinness tends to reduce their mass and reduces the need for coring.

Figure 2:
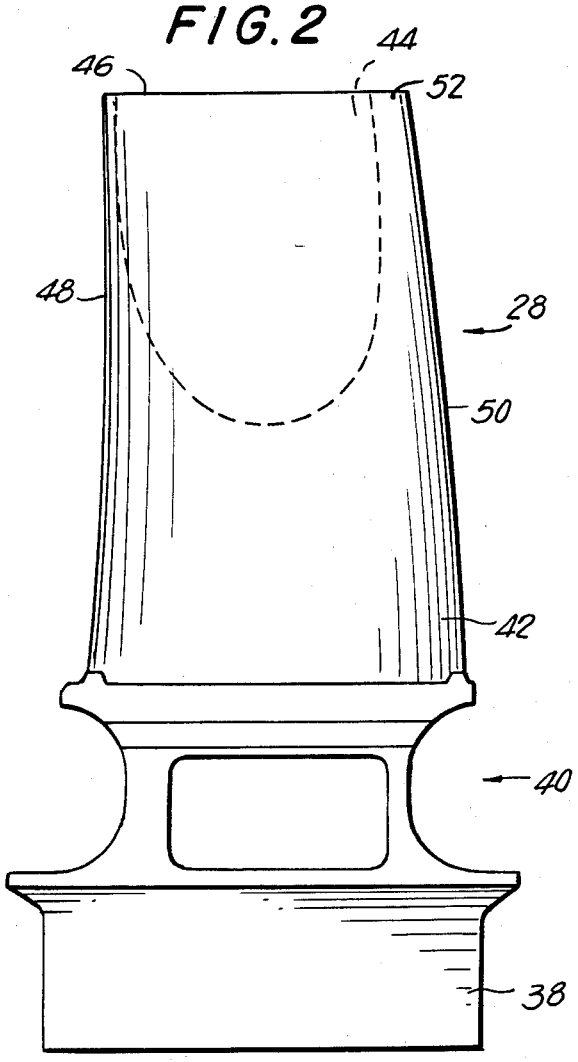
FIG. 2 is a side view of a turbine bucket.

Referring now to FIG. 2, there is shown a side view of a cored first-stage bucket 28. Bucket 28 includes a dovetail section 38 for fitting into a mating dovetail in a turbine wheel (not shown). First-stage turbine wheel 30 is made up of a full set of adjacent buckets 28 forming a ring. A shank section 40 joins dovetail section 38 to an aerodynamic section 42 which is exposed to high-speed hot gases in use and from which the turbine derives its torque.

In order to reduce the dovetail stresses and wheel loading and to optimize the stress distribution in aerodynamic section 42, it has been customary when casting a first-stage bucket 28 to include a core in the mold to produce a cavity 44 in the outer extremity of aerodynamic section 42. Cavity 44 is open at a tip 46. Aerodynamic section 42 includes a leading edge 48 and a trailing edge 50. Efficient aerodynamic design requires that leading edge 48 have a relatively large radius whereas trailing edge 50 has a very narrow radius. In fact, trailing edge 50 is often thinned to almost a knife edge to reduce energy losses from wake turbulence as the hot gases leave trailing edge 50. As a result of the thinness of the trailing edge and its taper to a very small radius, it has been customary to leave a substantial uncored section 52 between cavity 44 and trailing edge 50. Since the radius on leading edge 48 is normally considerably larger, coring can extend closer to leading edge 48 leaving a smaller uncored section (not shown).

The coring of cavity 44 is conventionally designed using appropriate analysis and testing to avoid vibratory resonance conditions in the remaining structure. However, first-stage buckets 28 may be subjected to transient resonant excitation especially during part load operation, which may set up unwanted vibratory modes.

Referring now to FIG. 3, the causes and location of cracking is described. In order to reduce the mass of bucket 28, particularly the mass at large radius, cavity 44 is made as large as possible so that the bounding walls 54 and 56 are relatively thin. If the thickness and geometry of walls 54 and 56 permit the setting up of vibrations at frequencies at which they can receive excitation, several types of vibration modes may result. Excitation can be produced by tip 46 rubbing a closely adjacent bounding surface in a manner similar to the excitation of a violin string when rubbed by a bow. Furthermore, various vibration frequencies resulting from slight imbalance in gas turbine 10, its load or fuel pressure fluctuations, can excite vibration of walls 54 and 56. In addition, each time a turbine bucket 28 passes into and out of the influence of a nozzle 32, an excitory input is given to bucket 28.

One type of vibratory motion of walls 54 and 56 is illustrated in dashed lines in FIG. 3 wherein walls 54 and 56 each move as a plate. Due to the difference in shapes of walls 54 and 56, they may have different frequencies so that one may vibrate under a certain excitation in the absence of vibration of the other. If both walls 54 and 56 are excited, they may be excited in a breathing mode in which they move outward and inward at the same time or they may be excited in step to both move in the same direction at the same time. It is also possible that neither of the above relationships exist even when both walls 54 and 56 are simultaneously excited. Due to the thinness of walls 54 and 56 and the relative thickness of uncored section 52, a stress concentration is set up by wall vibration adjacent to the aft end 58 of cavity 44.

Turbine buckets 28 are made of high strength, high temperature, high corrosion resistance alloys sometimes appropriately termed superalloys. Buckets 28 are fitted into a turbine shroud with the minimum permissible clearance for highest efficiency. Even using superalloys, elevated gas temperatures and centrifugal forces can cause bucket 28 to grow in length slightly into contact with the surrounding structure. Thus, tip 46 can become abraded.

Referring to FIG. 4, for example, tip 46 is abraded including the end portions of uncored section 52 and walls 54 and 56 and especially including the regions of these elements near aft end 58 of cavity 44. The wear applied by this abrasion can form grooves or striations 60 over the area of contact. Grooves or striations 60 may provide stress concentrations which can encourage the growth of cracks. It should be noted that, in the illustration of FIG. 4, striations 60 cover the portion of walls 54 and 56 adjacent to aft end 58 which received stress concentrations due to wall vibrations. Such stress concentrations due to striations 60 can thus be aggravated by the stress concentration due to wall vibration and can encourage the initiation and propagation of cracking.

A further source of stress concentrations appears to be vane-type flapping of a portion of uncored section 52 adjacent tip 46. Referring to FIG. 5, a vibratory mode of a portion 62 consisting of a generally triangular outer region of uncored section 52 may be vibrated, as indicated by the dashed lines, when exposed to an appropriate excitation frequency. A frequency of twice the nozzle passing frequency may be appropriate for exciting this mode of vibration. It will be noted that this mode of vibration is also capable of producing a stress concentration in wall 54 and/or 56 adjacent to aft end 58 of cavity 44. Thus, three phenomena coincide at the same time points on tip 46. lhat is, plate-like vibration of walls 54 and 56, rub-induced striations 60 and vane-type flapping of portion 62 of uncored section 52 all produce stress concentrations in walls 54 and 56 adjacent to aft end 58 of cavity 44.

Referring now to FIG. 3, these stress concentrations may be superposed to produce a radial crack 64 in one of side walls 54 or 56 adjacent to, and generally parallel to aft end 58 of cavity 44. A similar, but less frequent, mechanism may produce a crack 66 adjacent leading edge 48.

Referring now to FIGS. 6 and 7, the present invention employs a gradual transition 68 from aft end 58 of cavity 44 to tip 46. Transition 68 includes a curved portion 70 which may have any convenient shape such as semi-cylindrical, paraboloid or hyperboloid but is preferably a part of an ellipsoid. Curved portion 70 is joined by a ramp portion 72 inclined at an angle $\theta$ to the plane of tip 46.

Curved portion 70 begins a distance 74 below the perimeter of tip 46. Distance 74 is controlled by angle $\theta$ and a distance 76 between trailing edge 50 and rearmost point 78 of ramp portion 72. The angle $\theta$ may be from a few degrees to a value close to 90°. However, angle $\theta$ should preferably be between about 5° and about 45°.

Distance 74 may be varied according to the design of bucket 28 and the excitation frequencies to which it is subjected. In the preferred embodiment, distance 74 is from about 2 to about 15 percent of the length of aerodynamic section 42 (FIG. 2). In the most preferred embodiment, distance 74 is from about 2 to about 8 percent of the radial length of aerodynamic section 42.

In the preferred embodiment of the invention, stress concentrations at the junction of uncored section 52 and cavity 44 due to plate vibration of walls 54 and 56 occur in the region of curved portion 70 and along aft end 58 of cavity 44. However, since this region is located at distance 74 below tip 46, there is little or no superposition of stress concentrations due to striations or rubbing on tip 46 with stress concentrations due to plate-like vibration of walls 54 and 56. Similarly, stress concentrations arising from tip flap vibrations are removed from superposition with striations on tip 46. In addition, by appropriately shaping curved portion 70, stress concentrations may be spread out in that region such that the tendency for cracking is reduced or eliminated.

When bucket 28 is cast, a core (not shown) is conventionally disposed in the mold to produce cavity 44. In order to produce a bucket 28 according to the present invention, the core merely requires the addition of a flared transition section corresponding to transition 68 so that the cast bucket 28 is produced with transition 68 integrally formed therein. Alternatively, transition 68 may be added by machining in a conventional manner after casting. In either case, there is very little additional cost over the cost of conventional buckets for taking advantage of the present invention. In fact, except for modification of the core, no additional cost is anticipated for buckets 28 molded with transition 68 integrally formed therein.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A turbine bucket of the type having an aerodynamic section, a shank section and a dovetail section, comprising:

a cavity in said aerodynamic section extending inward from a tip of said aerodynamic section, said cavity defining walls adjacent thereto;

an uncored section between said cavity and at least one of a trailing edge and a leading edge of said bucket;

a transition between an end of said cavity adjacent said uncored section and said tip;

said transition including a curved portion curved toward said uncored section and a ramp portion continuing in said uncored section, said ramp portion including a first end joining said curved portion and a second end exiting said cavity at an extremity point of said ramp portion;

said curved portion beginning within said cavity radially inward of said tip between said walls at a radial distance from said tip; and said radial distance and said at least a curved portion being effective to displace a location of a maximum stress concentration produced by at least one vibration mode a sufficient distance from said tip within said cavity from a location of a maximum stress concentration produced by at least one other source of stress concentration that crack initiation in said walls is inhibited.

2. A turbine bucket according to claim 1, wherein said curved portion includes an elliptical portion.

3. A turbine bucket according to claim 1, wherein said ramp portion is inclined at an angle effective to produce said radial distance.

4. A turbine bucket according to claim 3, wherein said angle is from about 5 to about 45 degrees.

5. A turbine bucket according to claim 1, wherein said radial distance is from about 2 to about 15 percent of a radial dimension of said aerodynamic section.

6. A turbine bucket according to claim 5, wherein said radial distance is not greater than 8 percent of said radial dimension.

* * * * *